United States Patent [19]

Sebel et al.

[11] 4,105,271

[45] Aug. 8, 1978

[54] DESKS

[75] Inventors: Harry Sebel, Bankstown; Noel Sydney Davidson Wood, Hunters Hill, both of Australia

[73] Assignee: Sebel Limited, Australia

[21] Appl. No.: 811,389

[22] Filed: Jun. 29, 1977

[30] Foreign Application Priority Data

Jun. 30, 1976 [AU] Australia ..... 6480/76

[51] Int. Cl.[2] ..... A47B 3/00

[52] U.S. Cl. ..... 312/253; 312/255; 108/124; 248/163; 312/194

[58] Field of Search ..... 312/255, 256, 194–198; 297/172; 108/25, 26, 119, 124; 248/95 T

[56] References Cited

U.S. PATENT DOCUMENTS

| | | | |
|---|---|---|---|
| 2,140,635 | 12/1938 | Konarski | 297/172 |
| 2,230,511 | 2/1941 | Luttrup | 248/149 X |
| 2,709,633 | 5/1955 | Bargen | 248/163 |
| 2,846,285 | 8/1958 | Wright | 312/250 |
| 2,910,803 | 11/1959 | Close | 248/188.1 |
| 2,992,054 | 7/1961 | Pieschel | 312/255 |
| 2,997,339 | 8/1961 | Wilson | 248/188.1 |
| 3,106,295 | 10/1963 | Berlin | 108/119 |
| 3,247,811 | 4/1966 | Bauder | 108/124 |
| 3,256,840 | 6/1966 | Knoblock | 108/124 |
| 3,265,019 | 8/1966 | Haydock | 108/111 |
| 3,361,088 | 1/1968 | Hodgkin | 108/124 |
| 3,506,324 | 4/1970 | Fristedt | 312/231 |
| 3,622,199 | 11/1971 | Ho | 297/172 |
| 3,897,738 | 8/1975 | Minsky | 108/119 |

FOREIGN PATENT DOCUMENTS

| | | | |
|---|---|---|---|
| 1,564,803 | 3/1968 | France | 108/25 |
| 616,906 | 1/1949 | United Kingdom | 248/163 |

*Primary Examiner*—Casmir A. Nunberg
*Assistant Examiner*—Victor N. Sakran
*Attorney, Agent, or Firm*—Robert E. Burns; Emmanuel J. Lobato; Bruce L. Adams

[57] ABSTRACT

The present invention discloses a desk having a frame and a lid hinged to the frame. A box removably positioned within the frame is covered by the lid and provides storage and a transportage container for books and the like. A snap-on hinge formed from resilient material and suitable for securing the lid of the desk to the frame of the desk is also disclosed.

8 Claims, 8 Drawing Figures

DESKS

BACKGROUND OF THE INVENTION

This invention relates to desks and hinges suitable for desks. While the invention has particular application to school desks, to which the detailed description to follow will be directed, it also has application to other types of desks.

School desks are commonly of two types. One type has a writing surface in the form of a hinged lid, hinged toward its rear, by which access can be obtained to a compartment for holding books, stationery, etc. These desks are usually made from wood, and as a consequence the lids are heavy. The hinges are such that the lid can go well past the vertical and away from the desk and the hinges are therefore easily torn off. Taken with the weight of the lid, a student at one desk can be hit on the head by the lid of the desk behind. In addition, on release the lid closes with a loud bang.

The other type of school desk has a fixed writing surface, and a shelf underneath for storing books. This arrangement is inconvenient, a desired book being difficult to identify and extract, with a strong likelihood of one or more books falling to the floor.

At one time it was customary for a class or form to occupy one room, except for specialist subjects such as science requiring specialised equipment, and for teachers to move from class to class. Nowadays it is becoming more and more common for the teachers to stay in a particular classroom and for the students to move from class to class. This latter practice requires students to carry books, etc., from class to class, and in some schools molded plastic boxes have been provided which hold the books and which can be carried from room to room.

One object of this invention is to provide a desk having a hinged lid and a removable container in which books or the like can be stored and moved from place to place. Preferably, the lid is lightweight and its opening movement is limited.

Another object is to provide a hinge which is not easily broken and which is particularly suitable for use with such desks but is not restricted to such application.

SUMMARY OF THE INVENTION

According to one aspect of the present invention there is disclosed a desk comprising a frame including a substantially rectangular rack; a box having a base and four walls, at least two of said walls each having an outwardly extending flange; and a lid hinged to one side of said rack, said box being removably insertable within said rack and being maintained in position by engagement of said flanges with at least two of the other sides of said rack.

According to another aspect of the present invention there is disclosed a hinge for use in a desk as described immediately above, said hinge comprising a tube of resilient material having a substantially cylindrical inner surface and a longitudinally extending opening; said tube being resiliently deformable to permit said opening to be passed over a cylinder and said tube to be thereby retained on said cylinder; and means to secure said tube to a member to be hingedly moved relative to said cylinder.

BRIEF DESCRIPTION OF THE DRAWINGS

Two embodiments of the desk of the present invention and one embodiment of the hinge of the present invention will now be described with reference to the drawings in which.

DESCRIPTION OF THE PREFERRED DRAWINGS

Figure 1:
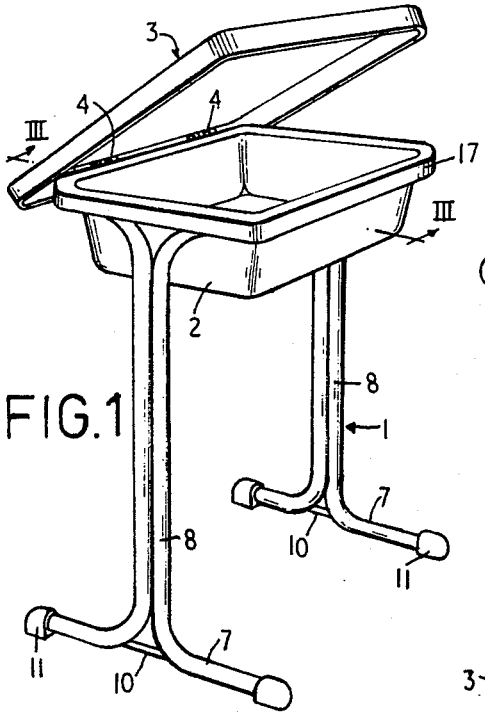
FIG. 1 is a perspective view of the desk of the preferred embodiment.
Figure 2:
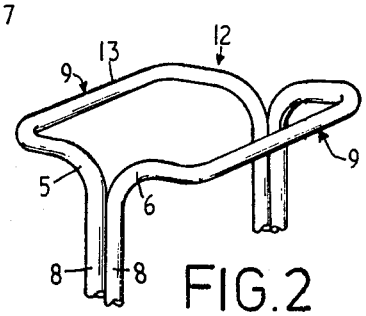
FIG. 2 is a perspective view of the upper part of the frame of the desk which is obscured in FIG. 1.
Figure 3:
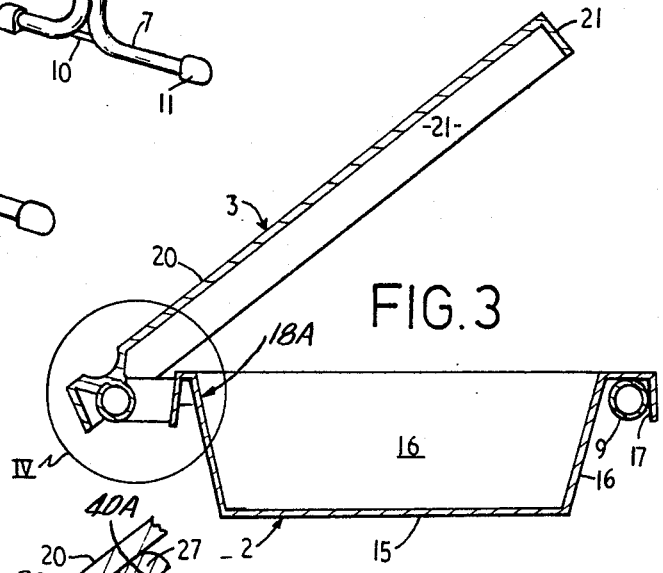
FIG. 3 is a cross-section of the desk of FIG. 1 taken along the line III—III of FIG. 1.

Referring now to FIGS. 1 to 3 the desk of the preferred embodiment comprises a frame 1, a box 2 which is removably insertable within the frame 1, and a lid 3 which is hingedly connected by means of two hinges 4 to the frame 1.

The frame 1 of the preferred embodiment is formed from two mirror-image portions 5 and 6 which are joined together, preferably by welding. Each of the mirror-image portions 5 and 6 comprises a pair of substantially parallel spaced apart feet 7 from which two legs 8 extend upwardly. The ends of the legs 8 are joined by substantially horizontal U-shaped members 9 which complete the mirror-image portions. The frame 1 is preferably formed from metal tubing which has been bent to the required shape and the two mirror-image portions 5 and 6 abut each other along the length of the legs 8. Preferably a small bracing member 10 is provided at the bottom of each pair of abutting legs 8 in order to increase the rigidity of the frame 1. In addition, small rubber or plastic ends 11 are provided for each of the feet 7.

As can best be seen in FIG. 2, the two U-shaped members 9 together extend around an area corresponding to the top of box 2, and constitute a substantially rectangular and substantially level rack 12 which has four sides and which receives the open topped box 2. One (rear) side 13 of the rack 12 receives the hinges 4 and the lid 3 therefore pivots about the rear side 13.

Figure 4:
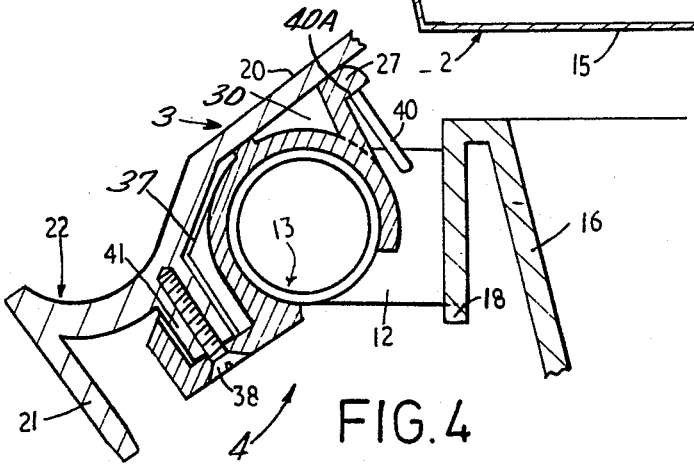
FIG. 4 is an enlarged detailed view of a portion of FIG. 3.
Figure 5:
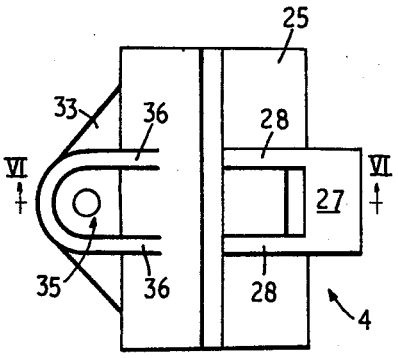
FIG. 5 is a plan view of the hinge of the preferred embodiment.

The open topped box 2 comprises a base 15 and four walls 16. Three of the walls 16 have a continuous L-shaped lip 17 extending from the upper edge thereof so as to form a downwardly opening channel which is dimensioned to receive the metal tubing which constitutes the rack 12. As seen in FIGS. 3 and 4 the remaining wall 16 of the box 2 has a strengthening skirt 18 depending at its upper edge, but is not constructed to receive the metal tubing which constitutes the rack 12.

The box 2 is removably insertable within the frame 1 by passing the base 15 through the rack 12 and engaging the lip 17 and its associated channel with the three sides of the rack 12 other than the rear side 13. In this way the box 2 is firmly located within the frame 1, but, because the dimensions of the box 2 are slightly less than those of the rack 12, the box 2 does not reach the rear side 13 of the desk. The skirt 18 is spaced from the lip 17 at 18A (FIG. 3), to permit the rack 12 to pass from underneath the lip 17 to the exterior of the skirt 18.

The lid 3 comprises a flat top 20 and a peripheral downwardly extending rim 21 which surrounds the top 20. A gutter 22 (FIG. 4) is provided in the top 20 of the lid 3 to enable students to place pencils and pens in the gutter 22 and hold same in position ready for use. The lid 3 is hinged to the rear side 13 by means of hinges 4 and is movable between a raised box open position, as seen in FIG. 1, and a lowered box closed position in which the top 20 provides a substantially level writing surface and the rim 21 surrounds the lip 17.

The preferred embodiment of the hinge 4 is illustrated in FIGS. 5 to 7 and FIG. 4 and comprises a tube 25 having, coextensively therewith, a longitudinally extending opening or slot 26 therein. The hinge 4 is formed from resilient material and is preferably molded from resilient, synthetic plastics material.

A tongue 27 parallel to the tube 25 extends tangentially from one side thereof and has, at each end, a small gusset 28. Running longitudinally along the upper outer surface of the tube 25 is a ridge 29. The upper surface of the ridge 29, gussets 28 and tongue 27 form a substantially flat surface 30 which abuts the inner surface of the top 20 of the lid 3 as will be explained hereinafter.

Figure 6:
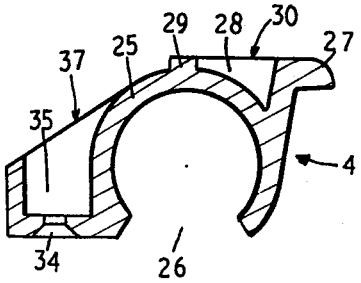
FIG. 6 is a cross-sectional view taken along the line VI—VI of FIG. 5.
Figure 7:
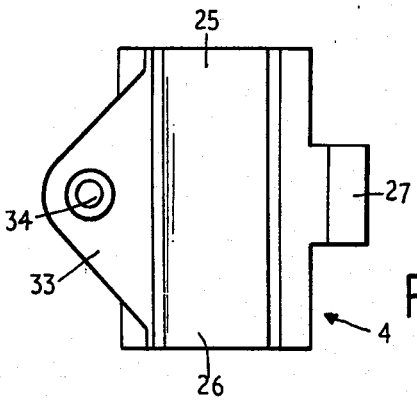
FIG. 7 is an underside view of the hinge of FIG. 5.

To the other side of the tube 25 extends a triangular flange 33. A countersunk aperture 34 in the flange 33 permits a fastening element such as a threaded fastener or screw 38 (FIG. 4) to pass through the flange 33 and into a cavity 35 formed between two webs 36 which connect the triangular flange 33 to the tube 25. As best seen in FIG. 6 the webs 36 have a sloping upper surface 37.

The interengagement of the rear side 13, the hinge 4 and the lid 3 is best seen in FIG. 4. An ear 40 having an aperture 40A therein extends from the underside of the top 20 of the lid 3. The tongue 27 of the hinge is passed through the aperture 40A in the ear 40 and the hinge 4 is moved against the lid 3 so as to bring the upper surface 30 of the ridge 29 and gussets 28 against the inner surface of the top 20. Simultaneously the cavity 35 (FIGS. 5 and 6) passes over a boss 41 extending from the underside of the lid 3 in the vicinity of the gutter 22. The sloping surface 37 of the webs 36 lies closely adjacent to the underside of the gutter 22. A threaded fastener 38 passes through the aperture 34 and threadedly engages an internally threaded bore in the boss 41 so as to secure the hinge 4 against the lid 3.

With both hinges 4 secured to the lid 3 in the positions illustrated in FIG. 1, the openings 26 in the hinges 4, FIG. 6, are placed on the rearside 13 of the rack 12. Then the lid 3 and hinges 4 are pushed downwardly onto the rear side 13 thereby causing the tube 25 to resiliently deform and pass onto the cylindrical rear side 13. The resilient nature of the hinge 4 enables the tube 25 to snap onto the rear side 13 and thereby retains the hinge 4 on the rear side 13. The cylindrical outer surface of the metal tubing forming the rear side 13 and the cylindrical inner surface of the tube 25 provide a good bearing surface which enables the lid 3 to be pivoted relative to the remainder of the desk.

As best seen in FIG. 4 continued movement of the lid 3 in the raised position beyond the vertical brings the rim 21, depending near the gutter 22 of the lid 3, into contact with the wall of the box 2 carrying the skirt 18. In this way the movement of the lid 3 is limited beyond a predetermined degree of opening without putting any substantial strain on the hinging mechanism for the lid. If the lid 3 is strongly raised beyond this predetermined degree of opening, the resilient tubes 25 expand permitting the lid 3 to come away from the desk 1. Then the lid 3 may be reinstalled by placing the hinges 4 on the rear side 13 again. This represents a considerable advance on prior art desks in which the lids were liable to be torn off at their hinges because of excessive opening and the excessive weight of the lid.

Figure 8:
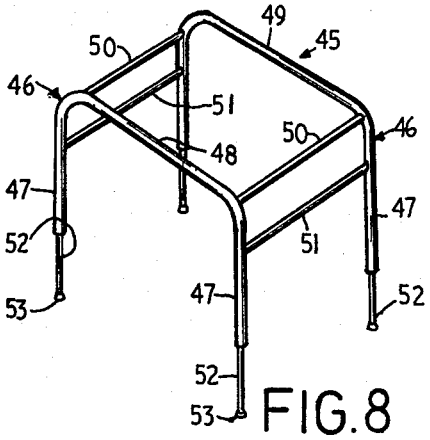
FIG. 8 is a perspective schematic view of the frame of a desk of a second embodiment.

A second embodiment of the desk of the present invention having box 2 and lid 3 as described above but an alternative frame 45, as illustrated in FIG. 8, will now be described. The frame 45 comprises two spaced parallel inverted U-shaped members 46 which are formed from tubular metal. Each U-shaped member 46 comprises two legs 47 separated by rods 48 and 49. The rods 48 and 49 are themselves separated by means of transverse bars 50 while the legs 47 are braced by means of struts 51. The bars 50 and struts 51 increase the rigidity of the frame 45 while the rods 48 and 49 and the bars 50 together comprise a substantially rectangular rack similar to rack 12 of FIG. 2.

Preferably the legs 47 are telescopically extendible by means of extensions 52 which are slidably mounted interior of the legs 47 and are releasably securable in a number of different positions so as to enable the height of the rods 48 and 49 above floor level to be adjusted. A plastics or rubber end 53 is pushed onto the lower end of each extension 52 in order to provide for non slip engagement between the frame 45 and the floor.

In order to assemble the desk using the frame 45 of FIG. 8, the box 2 is inserted within the rack formed by rods 48 and 49 and bars 50. In this embodiment the lip 17 of the box 2 engages bars 50 and rod 49 thereby leaving rod 48 free. The assembled lid 3 and hinges 4 are then brought into position above the rod 48 and the hinges 4 snapped onto the rod 48. Therefore the lid 3 is able to pivot about the rod 48 between the raised and lowered lid positions.

One advantage of the present invention is that the box 2 of the desks is removable. Therefore the desks may be used without the boxes 2 if a low cost desk is required. In addition the boxes 2 may be allocated to individual students who carry them from classroom to classroom and thereby use the boxes as a container for their books. Finally the boxes may be left in position within the desk frame and the desks used in the conventional manner. In consequence a single style of desk can provide one educational institution with a very flexible piece of equipment.

The foregoing describes only some embodiments of the present invention and modifications, obvious to those skilled in the art, may be made thereto without departing from the scope of the present invention.

What we claim is:

1. A desk, comprising; a frame of cylindrical metal tubing, including a portion which extends around a horizontal area to provide a substantially rectangular rack; a lid having a snap-on, snap-off hinge for hingedly connecting the lid to one side of the rack; and a box having a base and four walls, at least two of the walls each having an outwardly extending flange, and the box being removably insertable within the rack and being supported by engagement of the outwardly extending flanges with sides of the rack, the hinge comprising, a tube of resilient synthetic plastics material having a substantially cylindrical inner surface and a slot longitudinally extending from one to another end of the tube, the tube being resiliently deformable to permit the slot to be passed over said one of the rack sides, whereby the tube is releasably secured to said one side, and means for securing the tube to the lid, so that the lid is pivotable from a lowered box closing position in which the lid covers the top of the box, to a raised box opening position, subject to continued rotation of the lid causing resilient deformation of the hinge tube an release thereof from said one side of the rack.

2. A desk according to claim 1 wherein the securing means for the hinge comprises; a tongue extending away from one side portion of the tube for insertion in an aperture in a corresponding part of the lid; and a flange extending away from the other side of the tube and having an opening permitting passage of a securing bolt therethrough to secure the flange to the lid.

3. A desk according to claim 1, wherein the flange comprises a continuous lip of L-shaped cross-section forming a downwardly opening channel extending around the edge of three of said walls.

4. A desk according to claim 3 wherein the box and lid are of synthetic plastics material.

5. A desk according to claim 1, in which the frame comprises two mirror-image portions, each portion comprising two spaced substantially parallel feet, and two legs extending upwardly, one from each foot; and a U-shaped member forming half of the rack joining the upper ends of said legs, the corresponding legs of each mirror-image portion abutting each other along the length thereof.

6. A desk according to claim 1 wherein the frame comprises two spaced apart, parallel, inverted U-shaped members each having two legs joined by a rod; and two spaced apart transverse bars connecting respective ends of the rods, whereby the rods and bars comprise the rectangular rack.

7. A desk according to claim 6, wherein the length of the legs is telescopically adjustable.

8. A desk according to claim 1, additionally including a second hinge constructed and disposed similarly to the above-mentioned hinge, and spaced therefrom along said side of the rack.

* * * * *